US006714656B1

(12) United States Patent
Coffin

(10) Patent No.: US 6,714,656 B1
(45) Date of Patent: Mar. 30, 2004

(54) LOUDSPEAKER SYSTEM WITH DUST PROTECTION

(76) Inventor: C. Ronald Coffin, 18 John's La., Topsfield, MA (US) 01983

( * ) Notice: Subject to any disclaimer, the term of this patent is extended or adjusted under 35 U.S.C. 154(b) by 0 days.

(21) Appl. No.: 09/549,263

(22) Filed: Apr. 14, 2000

(51) Int. Cl.[7] ..... H04R 25/00
(52) U.S. Cl. ..... 381/420; 381/412
(58) Field of Search ..... 381/412, 419, 381/420, 407, 405, 396

(56) References Cited

U.S. PATENT DOCUMENTS

| | | | | |
|---|---|---|---|---|
| 3,796,839 A | | 3/1974 | Torn | 179/116 |
| 4,188,711 A | | 2/1980 | Babb | 29/594 |
| 4,312,118 A | | 1/1982 | Saik et al. | 29/594 |
| 4,508,941 A | * | 4/1985 | Wiggins | 381/412 |
| 4,727,586 A | | 2/1988 | Johnson | 381/186 |
| 4,832,150 A | | 5/1989 | Just et al. | 181/175 |
| 4,933,975 A | | 6/1990 | Button | 381/192 |
| 5,014,323 A | | 5/1991 | Markow et al. | 381/194 |
| 5,293,009 A | | 3/1994 | Fleischer | 181/169 |
| 5,357,586 A | | 10/1994 | Nordschow et al. | 381/199 |
| 5,687,247 A | | 11/1997 | Proni | 381/193 |
| 5,734,734 A | | 3/1998 | Proni | 381/194 |
| 5,742,696 A | | 4/1998 | Walton | 381/156 |

* cited by examiner

*Primary Examiner*—Curtis Kuntz
*Assistant Examiner*—Brian Ensey
(74) *Attorney, Agent, or Firm*—George A. Herbster

(57) ABSTRACT

A loudspeaker having an annular speaker cone with a central orifice, a voice coil bobbin attached to the annular speaker cone and a permanent magnet for producing a magnetic field in an air gap. A dust barrier blocks the transfer of material, such as magnetically attracted dust, through the central orifice into the air gap.

14 Claims, 5 Drawing Sheets

LOUDSPEAKER SYSTEM WITH DUST PROTECTION

BACKGROUND OF THE INVENTION

1. Field of the Invention

This invention generally relates to audio speaker systems and more specifically to dust barriers for loudspeakers used in such speaker systems.

2. Description of Related Art

A continuing effort is being applied to the development of loudspeakers for producing speaker systems that produce high-quality sound and that operate with maximum efficiency. This effort, in part, has been directed to developing new loudspeaker constructions, many of which are susceptible to damage from dust, particularly dust attracted by a magnetic field.

My U.S. Pat. No. 4,595,801 and U.S. patent application Ser. No. 09/251,815 filed Feb. 17, 1999 disclose dual cone loudspeakers with a primary speaker cone similar in function to a conventional dynamic loudspeaker mounted on a frame with a magnet structure. A secondary speaker cone mounts to a sub-frame on the back of the magnet structure and connects to the primary speaker cone through a rigid coupling device so the primary and secondary speaker cones move in unison. Sound waves from the secondary speaker cone travel through an orifice or throat through a center pole piece of the magnet structure and through an open center of the primary speaker cone radiating in the same direction as sound waves from the primary speaker cone. Consequently for a given excursion of the primary speaker cone my dual cone structure generates a sound having a greater sound volume than the primary cone alone by virtue of the simultaneous excursions of both the primary and secondary speaker cones that move a greater air volume for a given speaker cone displacement.

This dual cone speaker is one example of a speaker in which a single speaker cone or front speaker cone has an annular shape and a central orifice or throat. Dust can be attracted to the permanent magnet through the central orifice. If such particles accumulate in the air gap between a voice coil and the magnet, they can impede voice coil and speaker motion. When this occurs, the speaker's sound quality deteriorates. In more extreme situations, the accumulated attracted dust can cause permanent damage to the loudspeaker. What is needed is an apparatus or methodology for preventing the accumulation of attracted dust in the air gap, particularly in bass frequency loudspeakers in which a speaker cone undergoes a large linear displacement and requires high intensity magnetic fields in the air gap.

SUMMARY

Therefore it is an object of this invention to provide a dust barrier that minimizes dust accumulated in the air gap of a loudspeaker.

Another object of this invention is to provide a loudspeaker in which magnetically attracted dust particles are blocked physically from entering the air gap between a voice coil and speaker magnet.

In accordance with this invention, a loudspeaker with a frame that carries an annular speaker cone having a central opening driven by a voice coil on a bobbin in a magnetic field produced across an annular air gap in a magnetic structure that includes a throat aligned with the loudspeaker cone central opening. A ring is affixed to the speaker cone at the periphery of the central opening and an annular seal overlies a portion of the magnet structure within the throat. The ring operatively connects to the voice bobbin and the annular seal proximate the attachment of the speaker cone whereby the annular seal constitutes a barrier between the air gap and the throat thereby to block any dust that could be attracted into the air gap.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
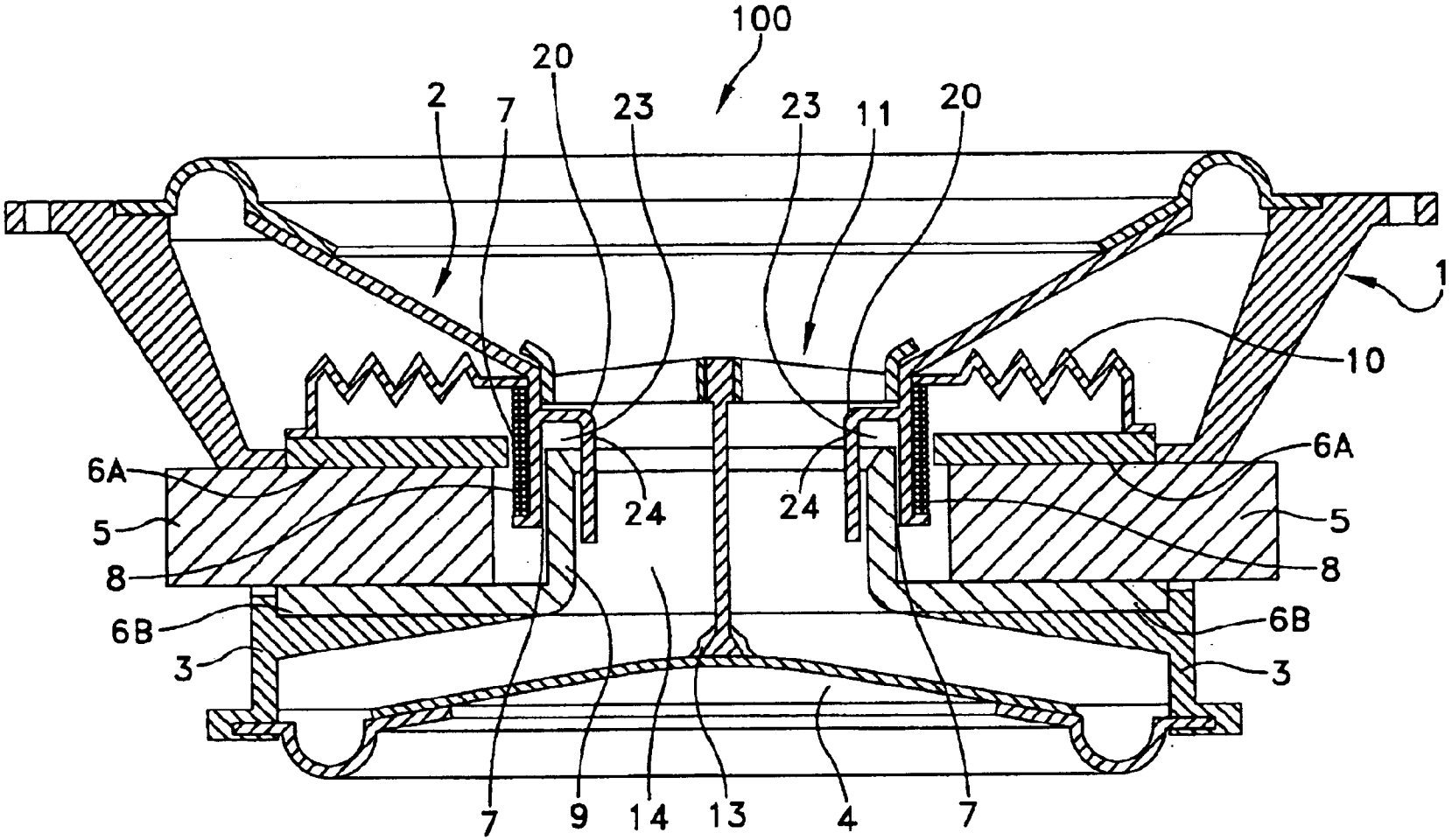
FIG. 1 is a cross section of a first embodiment of a loudspeaker constructed in accordance with this invention.

FIG. 1 depicts, in a schematic view and for purposes of understanding this invention, a first embodiment of a dual-cone loudspeaker 100 as constructed in accordance with the aforementioned patent disclosures and this invention. For reference, the dual cone loudspeaker includes a rigid frame 1 to which a first speaker cone in the form of an annular primary speaker cone 2 is attached and a subframe 3 to which a second speaker cone in the form of a secondary speaker cone 4 is attached. Both frames 1 and 3 are mounted with a permanent magnet 5 to which pole pieces 6A and 6B are attached to form a magnetic field air gap 7 between the pole piece 6A and a cylindrical extension 9 of the center pole piece 6B into which a voice coil bobbin 8 with a voice coil is placed. The voice coil bobbin 8 attaches to the base of the primary speaker cone 2 that is resiliently suspended from the frame 1 by a flexible surround at its outer periphery and by a spider 10 at its bottom. The spider 10 mounts to the frame 1 and the voice coil bobbin 8 to prevent any magnetically attracted or other dust from migrating into the air gap 7 between the voice coil 8 and the magnet 5. The spider also provide a centering force that maintains a coaxial relationship between the air gap 7 and the voice coil bobbin 8.

A rigid link 11 mechanically connects the voice coil bobbin 8 to the secondary speaker cone 4 by a center attachment 13 that may comprise a separate fastener or an adhesive material that bonds the link 11 to the secondary speaker cone 4. The secondary speaker cone 4 also attaches to the subframe 3 through a flexible surround and forms a second air piston that is pneumatically coupled to the primary speaker cone 2 through an orifice or aperture 14 through a center one of the pole pieces. This orifice 14 or throat is common to the closed sub-chamber formed by the secondary speaker cone 4 and subframe 3 and the open sub-chamber formed by the primary speaker cone 2.

The voice coil bobbin 8 encircles and is closely spaced to the cylindrical extension 9. As will be apparent, a transfer or migration path for magnetically attracted or other dust therefore exists from the exterior of the speaker 100 through the central orifice 14 into the air gap 7, particularly an air gap portion 10 between the voice coil bobbin 8 and the cylindrical portion 9.

Figure 2:
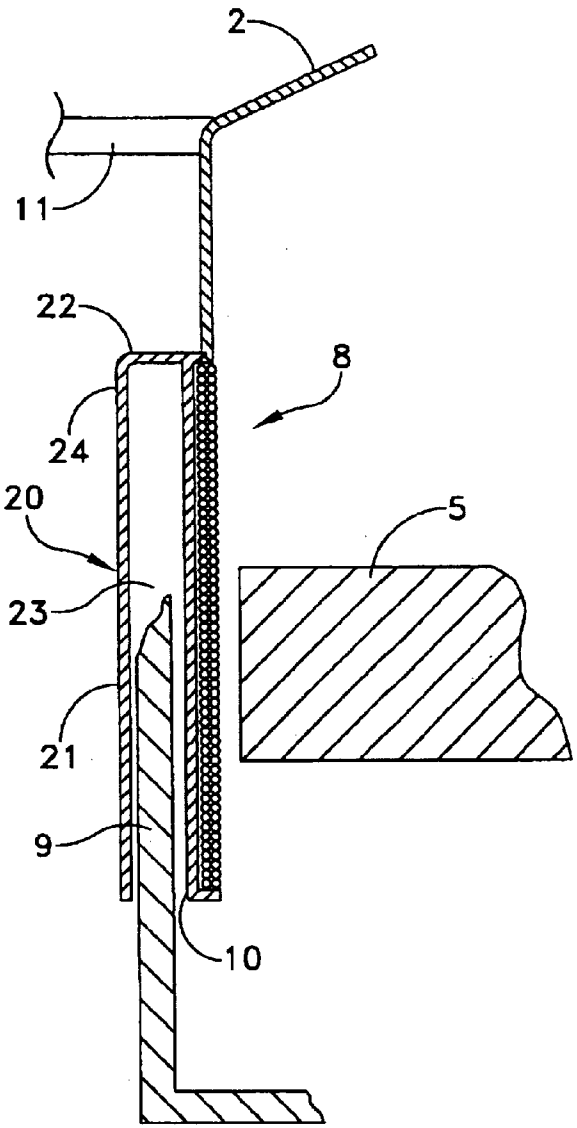
FIG. 2 is a detailed view of a portion of the loudspeaker shown in FIG. 1.

FIGS. 1 and 2 depict one embodiment of a barrier 20 that can block this path. More specifically, the barrier 20 includes a main cylindrical portion 21 that has a slightly smaller outer diameter than the inner diameter of the cylindrical pole piece portion 9. A transverse end portion 22 flares radially inwardly from the cylindrical portion 21 to form a closed support that attaches to the inside of the voice coil bobbin 8 by conventional attachment or by being formed integrally with the voice coil bobbin 8. As a result, the voice coil bobbin 8 and the cylindrical portion 21 form a closed-end channel 23 that nests the cylindrical center pole piece portion 9. As will be apparent, the depth of the channel 23 is selected to that the end portion 22 does not contact the open end of the cylindrical pole piece portion 9 during maximum excursions of the annual speaker cone 2.

Given the distribution of magnet fields in the speaker 100, any dust that passes through the orifice 14 is attracted to the barrier 20, particularly at the end portion 22 that blocks any transfer into the air gap 10 and is most clearly shown in FIG. 2. Rather the dust will coat an inner surface 24 of the barrier 20. It does not migrate to cylindrical extension 9 because the maximum attraction occurs in proximity to the end portion 22. Thus, the barrier 20 prevents magnetically attracted and other dust from migrating into the air gap 10.

Such a barrier 20 can be formed of any of a plurality of lightweight materials that will not distort the main magnetic field and will not add any significant mass to the voice coil bobbin 8. If the voice coil bobbin 8 is formed of a lightweight metal, the barrier 20 can be attached by welding, by adhesive or by other attachment procedures. If the voice coil bobbin 8 is formed of plastic, the barrier 20 can be integrally molded with the voice coil bobbin 8 or by attachment to the voice coil bobbin 8 by ultrasonic welding, adhesive or other attachment procedures. Although shown as a solid structure, the carrier 20 could also be formed as a stiff cloth or air permeable material that would block the passage of particles and yet allow air to pass.

Figure 3:
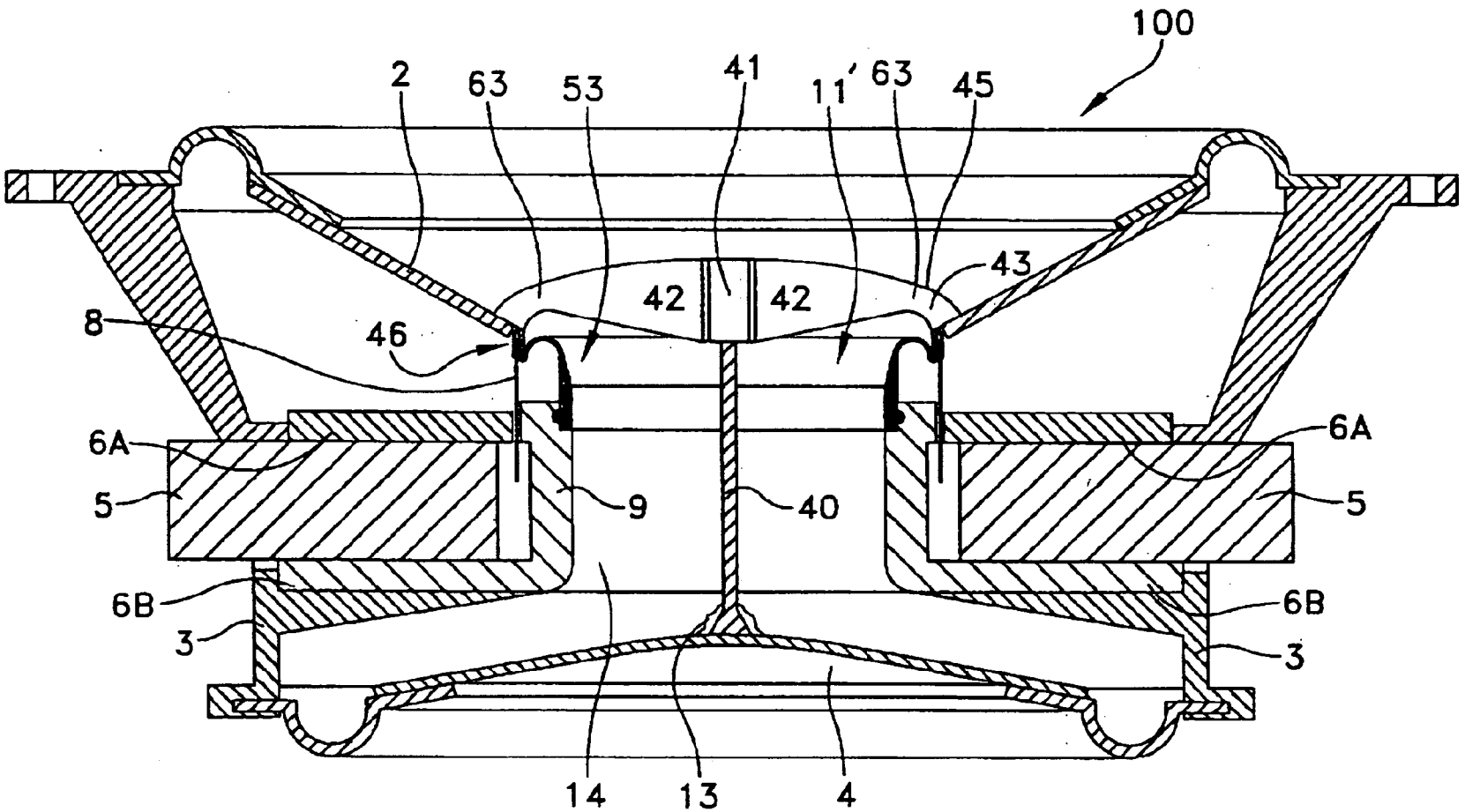
FIG. 3 is a cross section of another embodiment of a loudspeaker constructed in accordance with this invention.
Figure 4:
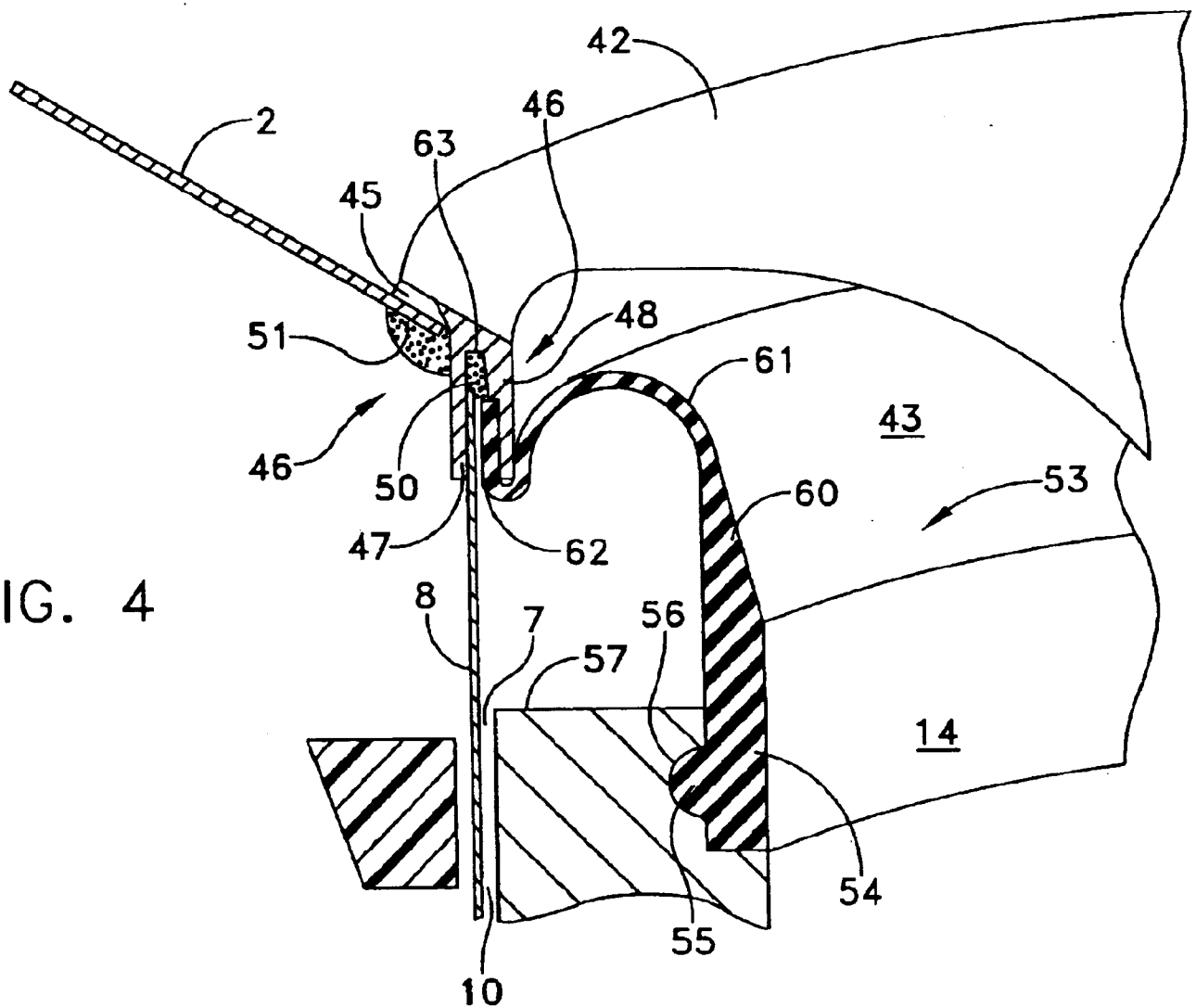
FIG. 4 is a detailed cross section of an alternate version of the embodiment of the loudspeaker shown in FIG. 3.

FIGS. 3 and 4 depict another embodiment of this invention particularly useful in a dual cone loudspeaker 100 that includes magnetic poles 6A and 6B with the magnetic pole 6B having an axially extending center pole portion 9 that defines the open orifice or throat 14 through the speaker. The throat continues through the annular primary cone 2. A rigid link 11' interconnects the primary cone 2 and the secondary cone 4. The rigid link 11' includes a center link 40 from the secondary cone and a center section 41 at the other end of the center link that carries equiangular spaced, radially extending spokes 42. The spokes carry an annular, circumscribing ring structure 43. The ring structure 43 supports the primary speaker cone 2 and the voice coil bobbin 8.

As shown in FIG. 3 and more clearly in FIG. 4, the ring 43 includes a top portion 45 that flares outwardly from an inner or axially extending, cylindrical, bifurcated portion 46. The bifurcation forms two spaced, axially extending fingers 47 and 48 that define an axially extending closed end slot 50.

The apex of the portions 45 and 46 serve as a site for the attachment of the primary cone 2 at the periphery of the central opening through the cone as by applying an adhesive 51 or in other manner as known in the art. As a result, motion of the primary cone 2 produces corresponding motion of the secondary cone 4 as previously described. The axially extending, cylindrical slot 50 receives the voice coil bobbin 8 that extends through the magnetic air gap 7. Only the bobbin 8 is shown in FIGS. 3 and 4 for simplicity. As will be apparent the bobbin also will carry a wound coil.

As previously indicated, with this structure the opening through the throat 14 and the space between angularly spaced spokes 42 constitute a path by which exterior dust can migrate into the air gap 7, particularly the air gap portion 10. In this embodiment, however, an annular seal 53 prevents such dust migration. The annular seal 53 includes a base portion 54 with an external bead 55. The base portion 54 is relatively thick and stiff, but allows for some compressibility whereupon the seal 53 can be inserted in the throat until the bead 55 seats in a circumferential groove 56 formed in the center pole piece 9. In this particular embodiment the groove 56 is formed in a seat for the thick body portion 54 thereby to minimize any interruption of air flow through the throat 14. Alternate structures also could be used for fixing the seal 53 to the interior of the magnet structure.

While the base portion 54 has a constant thickness to provide necessary rigidity, a neck section 60 tapers to provide a transition from the thick, relatively rigid base portion 54 to a thin, relatively flexible, inverted U-shaped portion 61. The portion 61 terminates proximate the axial ring portion 46 in an axially extending flange or collar 62 that fits into the slot 50.

During manufacture a fixture positions the voice coil bobbin 8 and the flange 62 in the slot 50. When positioned the slot 50 is filled with epoxy or another adhesive. When this process is finished, the ring 46 supports the seal 53, the voice coil bobbin 8 and the primary cone 2. As the voice coil 8 moves axially in response to electrical signals applied to the voice coil, the bobbin 8 drives the ring 43 that in turn drives the primary cone 2 and the secondary cone 4 through the central link 11'. During this motion the axially flexible thin portion 61 allows the unimpeded motion while providing an impermeable membrane between the throat 14 and the air gap portion 10.

As shown particularly in FIG. 3, the spokes 42 are shaped with a vertical or axial offset at 63. This offset allow full range of axial motion without any interference between the seal 53 and the spokes 42.

In this embodiment the seal 53 serves two functions and may provide an optional third function. First, the seal 53 acts as a barrier to prevent dust from passing through the throat 14 to the air gap portion 10. If the seal 53 is made of an impermeable material, the seal 53 prevents an air leakage from the throat 14 to the rear surface of the primary cone 2 that could have deleterious effect on performance. FIG. 3 shows the use of the seal 53 and the ring 43 without any attached spiders, such as the spider 10 in FIG. 1. The seal 53 can also provide a centering function thereby to assure the proper positioning of the voice coil bobbin 8 within the air gap 7.

Figure 5:
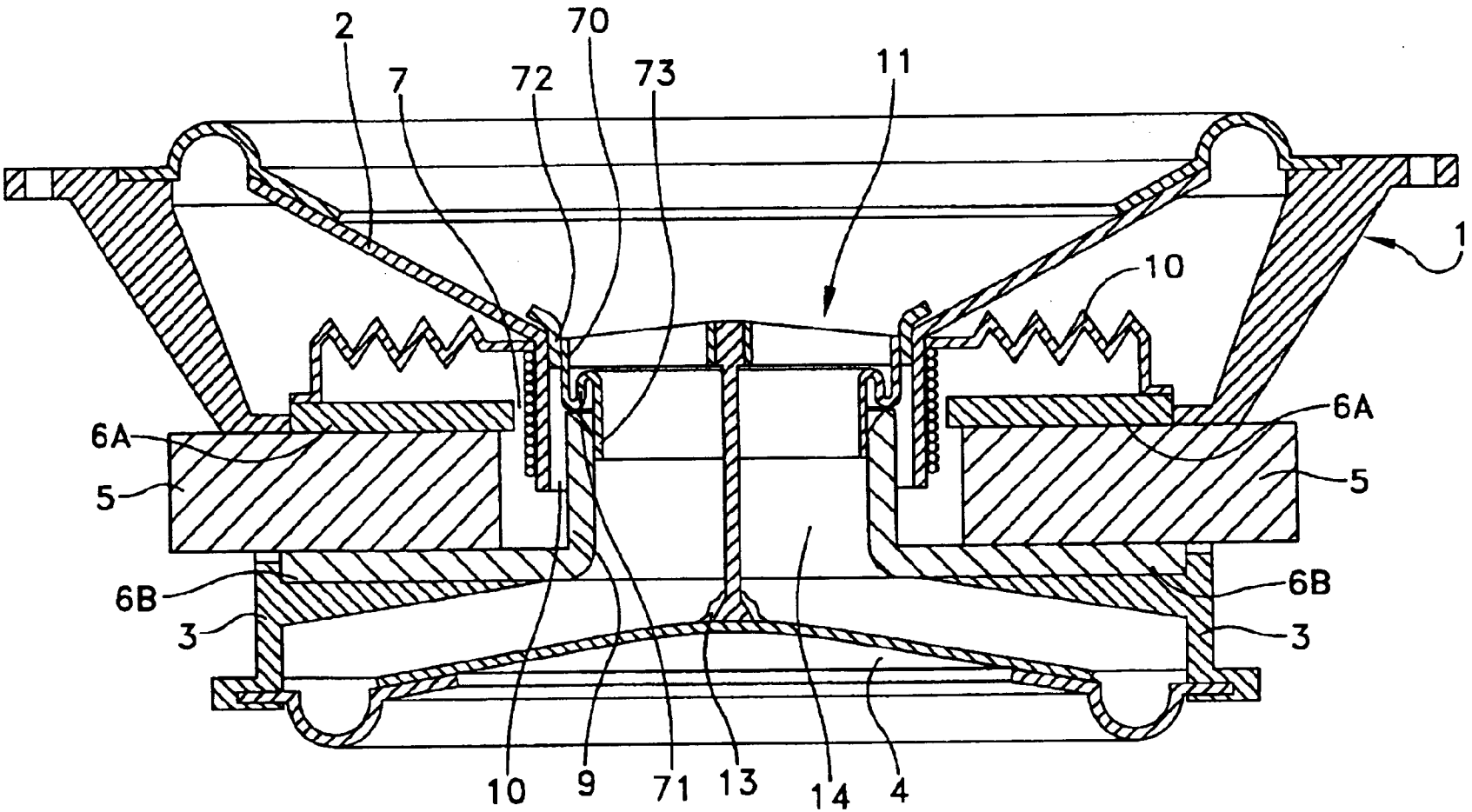
FIG. 5 is a cross-section of a third embodiment of the loudspeaker constructed in accordance with this invention.
Figure 5:
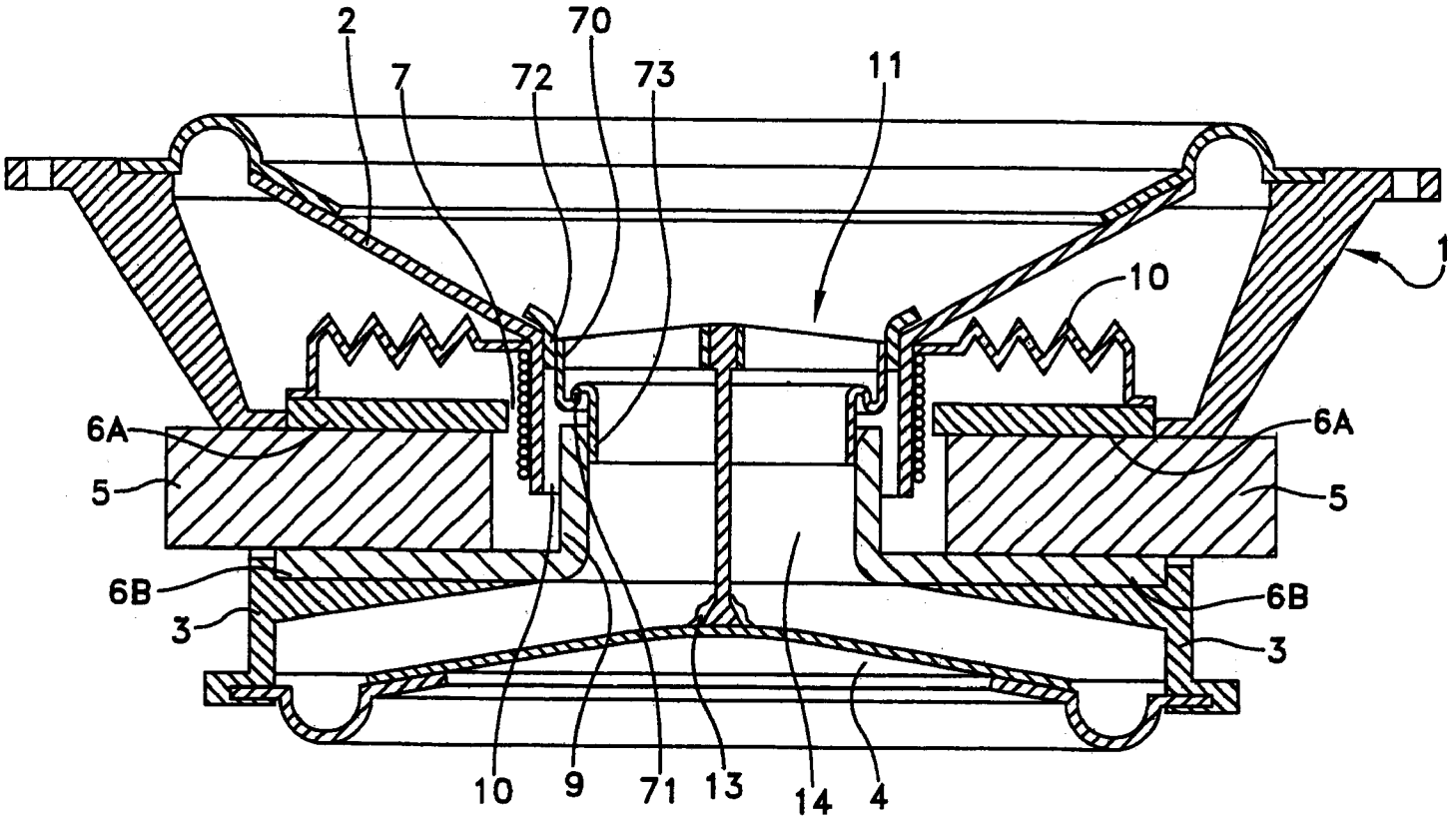

FIG. 5 depicts still another embodiment of this invention with a seal or barrier 70 that comprises a resilient cylindrical element with a portion 71 folded back on itself to produce a U-shape, much like a common rolling rubber or foam cone edge surround. With this approach, as the rigid link 11 and voice coil 8 move longitudinally outward, the intermediate portion 71 expands so the amount of material within the intermediate portion reduces. As the voice coil 8 and rigid link 11 move in the opposite direction, the amount of material in the intermediate portion increases as the distance between the upper and lower portions 72 and 73 decreases. The configuration must be such that the folded portion 71 does not interfere mechanically with the full range of motions of the voice coil bobbin 8 and the rigid link 11. FIG. 5 also depicts a loudspeaker 100 with a spider 10. If the barrier 70 has sufficient lateral stability, that is, if the barrier 70 can maintain the coaxial relationship of the annular air gap 7 and the voice coil bobbin 8, the spider 10 could be eliminated in these cases where centering is the primary function of the spider 10.

Thus in accordance with this invention there have been disclosed a number of barriers that prevent the accumulation of magnetically attracted dust and other materials into critical air gaps of the loudspeaker through an annular speaker cone. This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. In a loudspeaker with a frame that carries an annular speaker cone having a central opening driven by a voice coil on a bobbin in a magnetic field produced across an annular air gap in a magnetic structure that includes a throat aligned with the loudspeaker cone central opening whereby dust can be attracted into the magnetic field air gap through the loudspeaker cone central opening, the improvement comprising:

A) an axially flexible annular seal overlying a portion of the magnet structure within the throat, and B) a ring affixed to the speaker cone at the periphery of the central opening, said ring including means for attaching to said seal and said voice coil bobbin and proximate the attachment of the speaker cone whereby said annular seal constitutes a barrier between the air gap and the throat to prevent the attraction of dust into the air gap.

2. A loudspeaker as recited in claim 1 wherein said ring includes a cylindrical portion for supporting said attaching means.

3. A loudspeaker as recited in claim 2 wherein said attaching means at said cylindrical portion of said ring is bifurcated into spaced fingers thereby to form a slot that receives said seal and the voice coil bobbin and wherein said slot is filled with material for affixing the voice coil bobbin and said seal in said slot.

4. A loudspeaker as recited in claim 3 wherein said seal includes a thick portion for attachment to the magnetic structure in the throat, an intermediate thin, flexible portion and an attachment flange in said slot.

5. A loudspeaker as recited in claim 4 wherein seal additionally comprises a tapered portion intermediate said flexible portion and said thick portion.

6. A loudspeaker as recited in claim 5 wherein said intermediate flexible portion is formed with a U-shape.

7. A loudspeaker as recited in claim 5 wherein the magnetic structure includes an annular center pole piece that circumscribes the throat, said center pole piece being form with a recess for receiving the thick portion and a circumferential groove in said recess and said seal includes a circumferential bead for seating in said groove thereby to affix said seal to the magnet structure.

8. In a loudspeaker with a frame that carries a first, annular speaker cone having a central opening driven by a voice coil on a bobbin in an annular magnetic field produced across an air gap in a magnetic structure that includes a throat aligned with the loudspeaker cone central opening whereby dust can be attracted into the magnetic field air gap through the loudspeaker cone central opening, and a second speaker cone mounted to the frame and located on the opposite side of the magnet structure from the first speaker cone, the improvement of a link for interconnecting the first and second speaker cones through the magnet structure, said link comprising:

A) a rigid elongated member attached to the center of the second speaker cone and extending axially through the throat, B) a ring assembly affixed to the first speaker cone at the periphery of the central opening and affixed to said rigid elongated member whereby motion of the first speaker cone produces corresponding motion of the second speaker cone, and C) an annular seal overlying a portion of the magnet structure within the throat, said ring being operatively connected to the voice coil bobbin and said annular seal proximate the attachment of the speaker cone whereby said annular seal constitutes a barrier between the air gap and the throat.

9. A loudspeaker as recited in claim 8 wherein said ring structure includes a plurality of thin spokes extending radially from said rigid elongated member and a ring having a cylindrical portion attached to the ends of said spokes.

10. A loudspeaker as recited in claim 9 wherein said cylindrical portion of said ring is bifurcated into spaced fingers thereby to form a slot that receives said seal and the voice coil bobbin and wherein said slot is filled with material for affixing the voice coil bobbin and said seal in said slot.

11. A loudspeaker as recited in claim 10 wherein said seal includes a thick portion for attachment to the magnetic structure in the throat, an intermediate thin, flexible portion and an attachment flange in said slot.

12. A loudspeaker as recited in claim 11 wherein seal additionally comprises a tapered portion intermediate said flexible portion and said thick portion.

13. A loudspeaker as recited in claim 12 wherein said intermediate flexible portion is formed with a U-shape.

14. A loudspeaker as recited in claim 12 wherein the magnetic structure includes an annular center pole piece that circumscribes the throat, said center pole piece being form with a recess for receiving the thick portion and a circumferential groove in said recess and said seal includes a circumferential bead for seating in said groove thereby to affix said seal to the magnet structure.

* * * * *

UNITED STATES PATENT AND TRADEMARK OFFICE

CERTIFICATE OF CORRECTION

PATENT NO. : 6,714,656 B1
DATED : March 30, 2004
INVENTOR(S) : Coffin

It is certified that error appears in the above-identified patent and that said Letters Patent is hereby corrected as shown below:

The title page, showing an illustrative figure, should be deleted and substitute therefor the attached title page.

Drawings,
Delete figure 5 and substitute therefor the figure consisting figure 5 as shown on the attached page.

Signed and Sealed this

Seventh Day of September, 2004

JON W. DUDAS
*Acting Director of the United States Patent and Trademark Office*

(12) United States Patent
Coffin

(10) Patent No.: US 6,714,656 B1
(45) Date of Patent: Mar. 30, 2004

(54) LOUDSPEAKER SYSTEM WITH DUST PROTECTION

(76) Inventor: C. Ronald Coffin, 18 John's La., Topsfield, MA (US) 01983

( * ) Notice: Subject to any disclaimer, the term of this patent is extended or adjusted under 35 U.S.C. 154(b) by 0 days.

(21) Appl. No.: 09/549,263

(22) Filed: Apr. 14, 2000

(51) Int. Cl.[7] ..... H04R 25/00
(52) U.S. Cl. ..... 381/420; 381/412
(58) Field of Search ..... 381/412, 419, 381/420, 407, 405, 396

(56) References Cited

U.S. PATENT DOCUMENTS

| | | | | |
|---|---|---|---|---|
| 3,796,839 A | | 3/1974 | Torn | 179/116 |
| 4,188,711 A | | 2/1980 | Babb | 29/594 |
| 4,312,118 A | | 1/1982 | Saik et al. | 29/594 |
| 4,508,941 A | * | 4/1985 | Wiggins | 381/412 |
| 4,727,586 A | | 2/1988 | Johnson | 381/186 |
| 4,832,150 A | | 5/1989 | Just et al. | 181/175 |
| 4,933,975 A | | 6/1990 | Button | 381/192 |
| 5,014,323 A | | 5/1991 | Markow et al. | 381/194 |
| 5,293,009 A | | 3/1994 | Fleischer | 181/169 |
| 5,357,586 A | | 10/1994 | Nordschow et al. | 381/199 |
| 5,687,247 A | | 11/1997 | Proni | 381/193 |
| 5,734,734 A | | 3/1998 | Proni | 381/194 |
| 5,742,696 A | | 4/1998 | Walton | 381/156 |

* cited by examiner

*Primary Examiner*—Curtis Kuntz
*Assistant Examiner*—Brian Ensey
(74) *Attorney, Agent, or Firm*—George A. Herbster

(57) ABSTRACT

A loudspeaker having an annular speaker cone with a central orifice, a voice coil bobbin attached to the annular speaker cone and a permanent magnet for producing a magnetic field in an air gap. A dust barrier blocks the transfer of material, such as magnetically attracted dust, through the central orifice into the air gap.

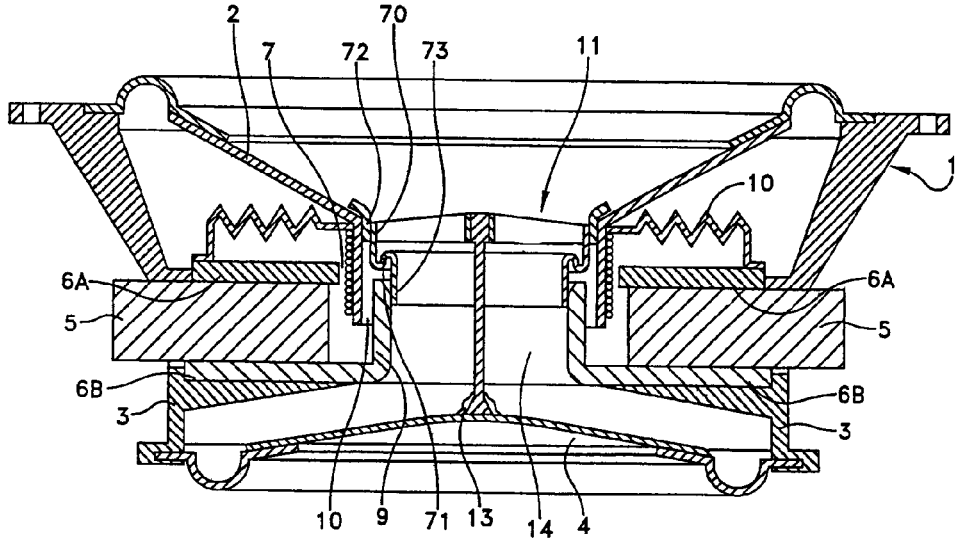

14 Claims, 5 Drawing Sheets